US006568866B1

(12) United States Patent
Hsu

(10) Patent No.: US 6,568,866 B1
(45) Date of Patent: May 27, 2003

(54) MECHANICAL PENHOLDER

(76) Inventor: Jung Lin Hsu, PO Box 82-144, Taipei (TW)

( * ) Notice: Subject to any disclaimer, the term of this patent is extended or adjusted under 35 U.S.C. 154(b) by 0 days.

(21) Appl. No.: 10/133,493

(22) Filed: Apr. 29, 2002

(51) Int. Cl.[7] ..... B43K 7/12
(52) U.S. Cl. ..... 401/117; 401/6; 401/99
(58) Field of Search ..... 401/99, 103, 6, 401/48, 104

(56) References Cited

U.S. PATENT DOCUMENTS 3,181,507 A * 5/1965 Dannebaum ..... 401/104
3,192,904 A * 7/1965 Johmann ..... 401/103
6,056,462 A * 5/2000 Fukai et al. ..... 401/6

* cited by examiner

*Primary Examiner*—David J. Walczak
(74) *Attorney, Agent, or Firm*—Leong C. Lei

(57) ABSTRACT

A mechanical penholder preventing the refill from direct impact when falling on the ground and preventing the refill from being retracted in use is comprised of upper and lower holders engaged to contain a refill, which penetrates through the lower holder characterized by that a recess at the top inside the upper holder to accommodate a coil, the lower holder being inserted into a collet; and multiple stubs disposed on the collet penetrating and protruding from multiple corresponding holes in the lower holder; the refill mildly retracts into the holder and restores to its original position to prevent it from being broken due to head-on crash against the ground; and the user may hold the lower holder by pressing against it so to allow those stubs sticking out to hold against the outer side of the refill to prevent is from retracting into the lower holder while writing.

1 Claim, 7 Drawing Sheets

MECHANICAL PENHOLDER

BACKGROUND OF THE INVENTION (a) Field of the Invention

The present invention is related to a mechanical penholder, and more particularly, to one that effectively provides longer service life for a refill in a mechanical pen by preventing it from retraction and facilitates writing by compromising the force exercised to penholder by an individual user.

(b) Description of the Prior Art

A mechanical pen generally available in the market is essentially comprised of a holder containing a refill that extending through the lower end of the holder. However, the mechanical pen of the prior art is found with the following detectives:

(1) The tip of the refill is vulnerable to be cured and deformed due to the force exercised upon penholder and can be broken up in serious case, significantly reducing service life of the refill;

(2) Whereas the outlet of ink is very sensitive and fragile and can be easily blocked or interrupted if excessive or insufficient writing force is exercised, thus preventing a nice and neat writing and frustrating the desire for a buy by the consumer; and (3) Improper placement or careless holding of the penholder frequently causes the pen to accidentally fall on the ground, resulting in a "head-on" crash against the ground in the absence of any buffer means provided to the refill, and an immediate replacement of the refill is required.

SUMMARY OF THE INVENTION

The primary purpose of the present invention is to provide a mechanical penholder with a buffer to prevent the refill from being forthwith subject to impact from falling on the ground and to retrain the refill from being retracted in use. To achieve the purpose, the present invention is comprised of an upper and a lower holders engaged to each other to contain a refill, which penetrates through the lower holder characterized by that a recess being provided at the top inside the upper holder to accommodate a coil with the coil pressing against the top end of the refill; the lower holder being inserted into a collet; and multiple stubs disposed on the lower circumference of the collet penetrating and protruding from multiple corresponding holes in the lower holder. Accordingly, in case that the pen accidentally falls onto the ground, the refill mildly retracts into the holder and restores to its original position due to the coil thus to prevent the refill from being broken due to head-on crash against the ground. Furthermore, as the writing force exercised by an individual user varies, the refill may be retracted in case of excessive force is applied to the lower holder. In such case, the user may hold the lower holder by pressing against it so to allow those stubs sticking out to hold against the outer side of the refill to prevent is from retracting into the lower holder.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
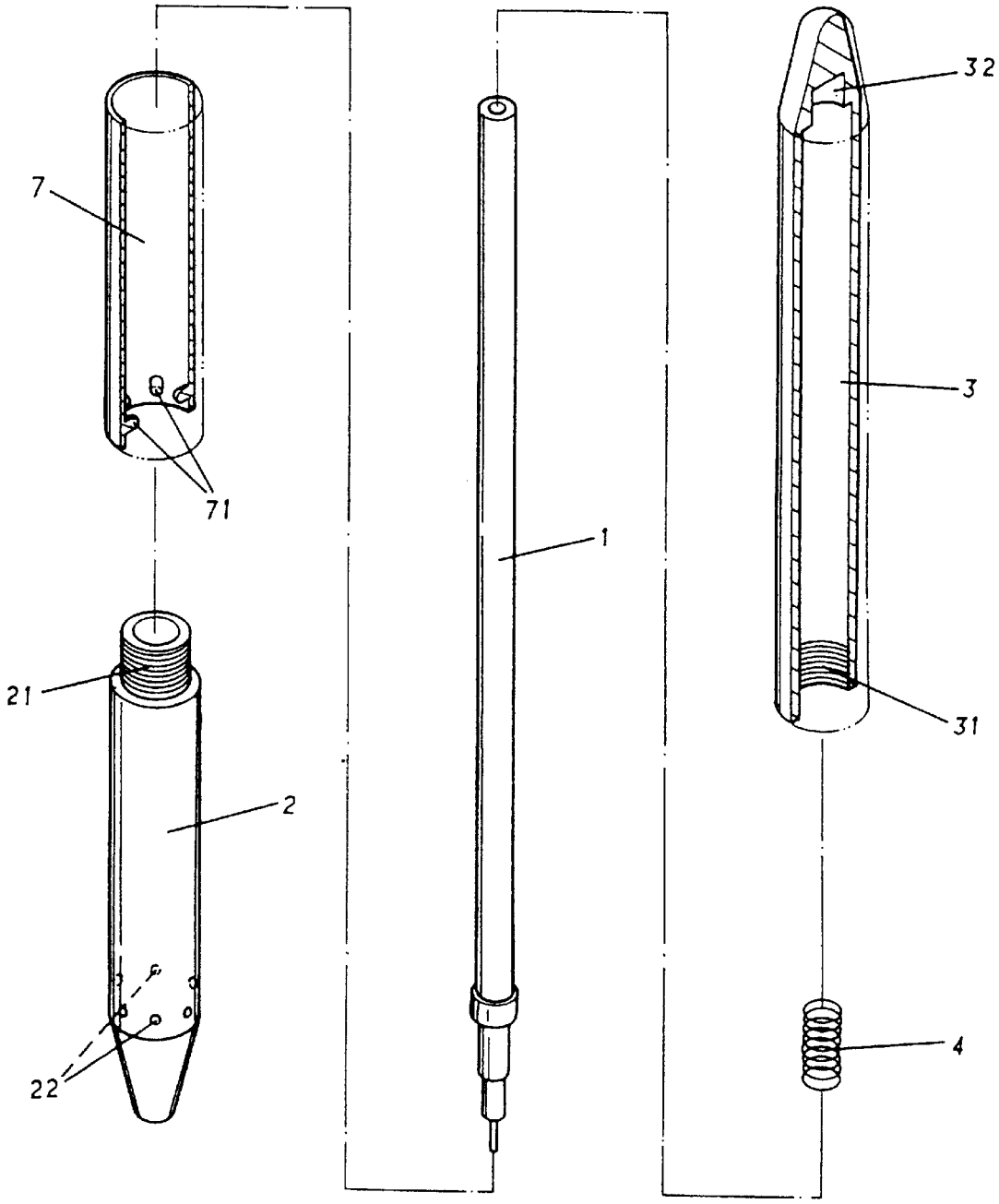
FIG. 1 is a perspective view of a preferred embodiment of the present invention.
Figure 2:
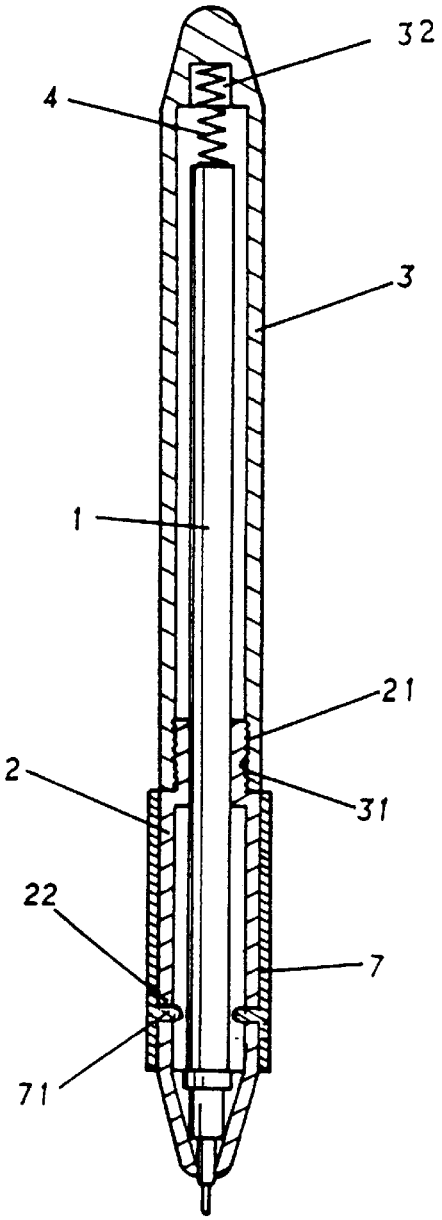
FIG. 2 is a sectional view of an assembly of the preferred embodiment of the present invention.
Figure 4:
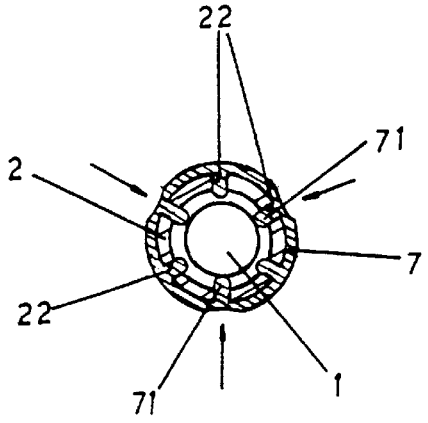
FIG. 4 is a cross sectional view showing a refill is retained by a stub in the preferred embodiment of the present invention.
Figure 3:
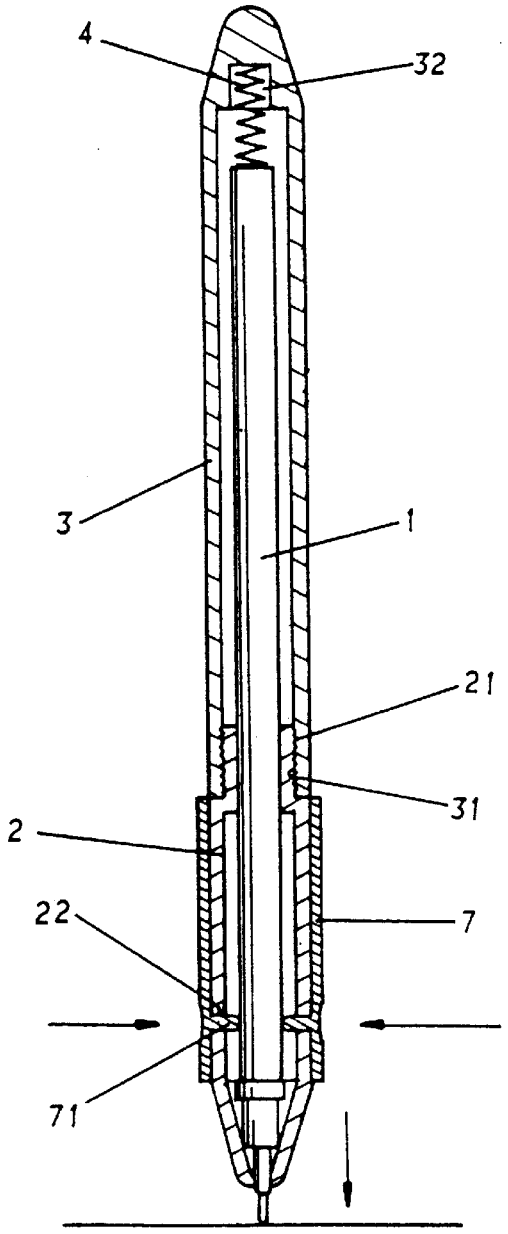
FIG. 3 is a sectional view showing a hand-held press collet of the preferred embodiment of the present invention.

Referring to FIGS. 1 and 2, a first preferred embodiment of the present invention is comprised of having a refill 1 to be inserted into a lower holder 2; the top of the lower holder 2 is provided with an externally threaded portion 21, which is screwed to an inner threaded portion 31 at the bottom of an upper holder 3 for both holders 2, 3 to contain the refill penetrating through the lower end of the lower holder 2 for writing purpose characterized by that:

A recess 32 containing a coil 4 is provided at the top inside the upper holder 3 with the coil 4 holding against the top end of the refill 1. Multiple holes 22 are provided at equal spacing at the lower part of the lower holder 2 and the lower holder 2 is inserted into a rubber collet 7 provided at its inner circumference multiple stubs 71 inserted into their corresponding holes 22. When in use, the lower holder 2 is held at its lower portion. If excessive force is applied to make the refill 1 overcome resilience of the coil, the refill 1 will retract inside. To prevent said retraction of the refill 1, the outer side at the base of the collet 7 is slightly depressed (by one's thumb, index finger and middle finger together) as illustrated in FIGS. 3 and 4 to push those multiple stubs 71 into three points and hold against the outer side of the refill 1. On the contrary, if one's writing behavior features comparatively weaker force applied, he simply needs to hold the lower holder 2 at higher location to release those stubs 71 from holding against the outer side of the refill 1 for the coil 4 to prevent retraction of the refill 1. In either case, the present invention prevents interrupted writing.

Figure 5:
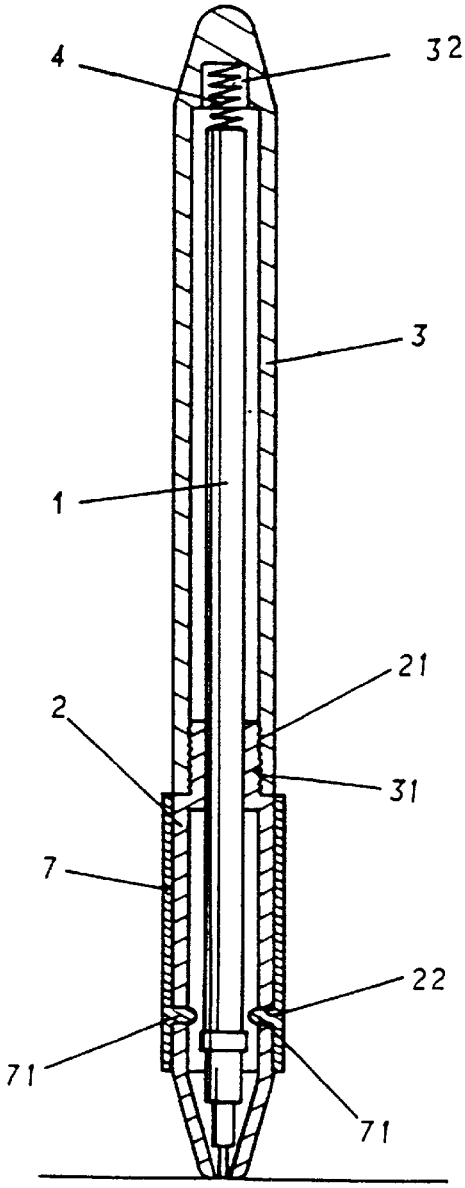
FIG. 5 is a schematic view showing a refill retraction buffer in the preferred embodiment of the present invention.

The mechanical pen may accidentally fall onto the ground when it is improperly placed or carelessly held, and the refill 1 may be subject to a head-on impact against the ground as illustrated in FIG. 5. The refill 1 retracts and immediately returns the refill 1 to its original place due to buffering produced by the coil 4 at the moment of the impact as illustrated in FIG. 2. Said buffering produced by the coil 4 effectively protects the refill 1 from breaking, thus to extend the service life of the mechanical pen of the present invention.

Figure 6:
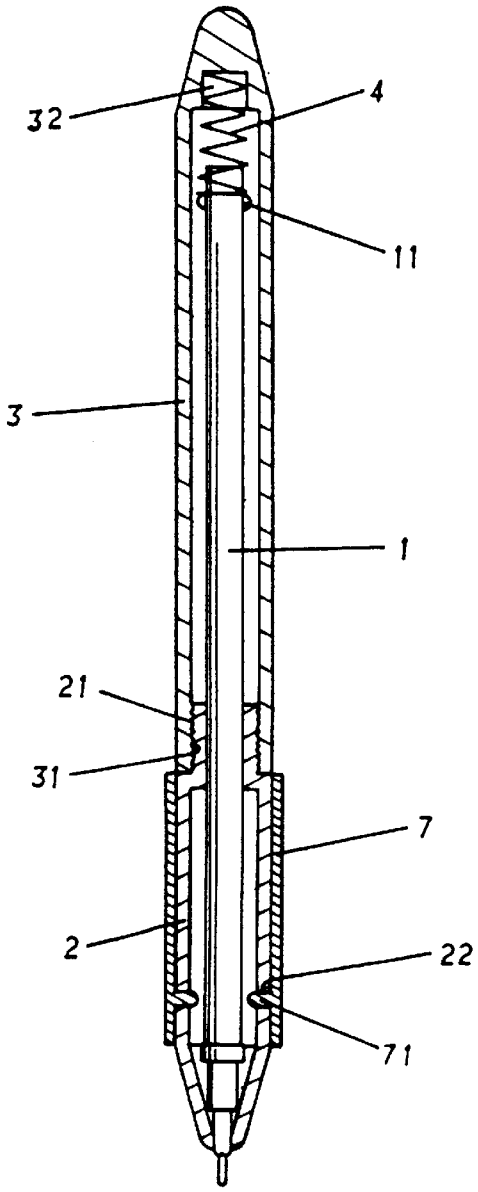
FIG. 6 is a sectional view of an assembly of another preferred embodiment of the present invention.
Figure 7:
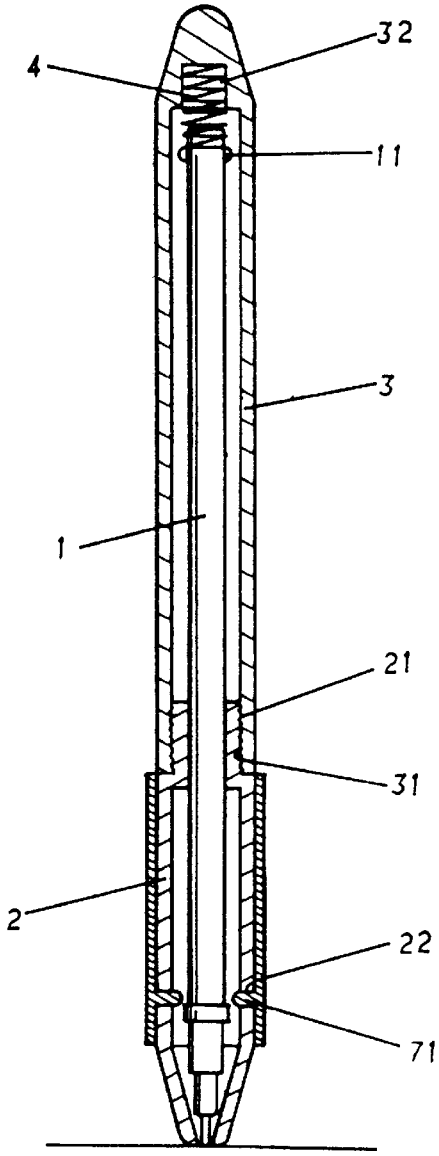
FIG. 7 is a schematic view showing that a refill retraction buffer in another preferred embodiment of the present invention.
Figure 8:
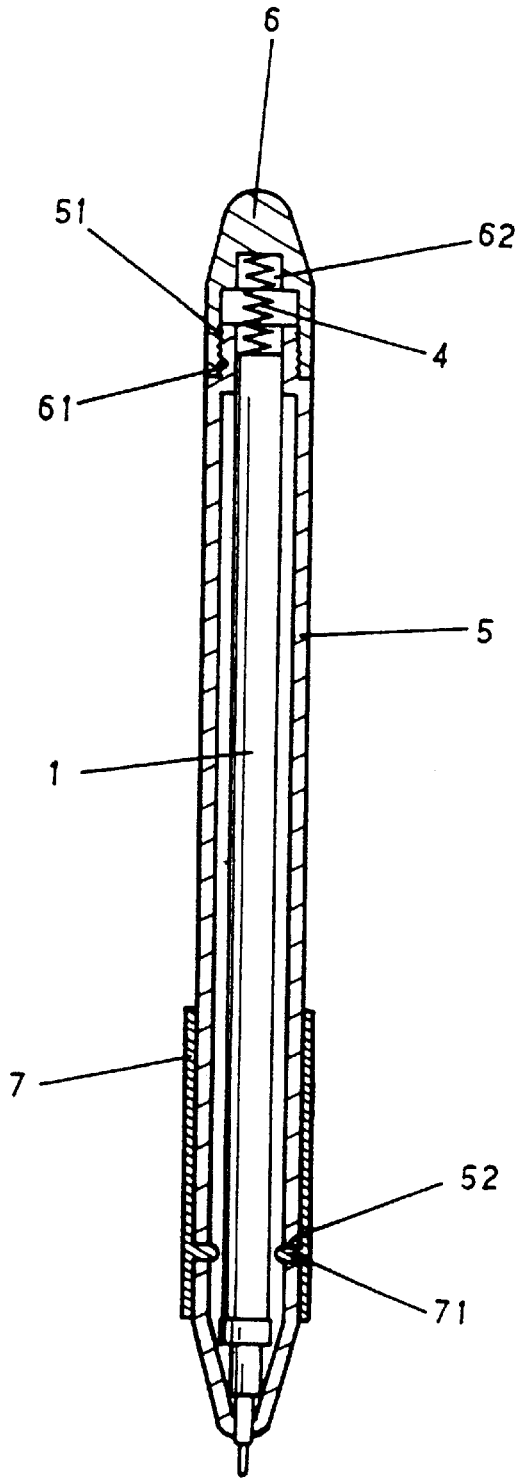
FIG. 8 is a sectional view of the assembly of another preferred embodiment of the present invention is in use.
Figure 9:
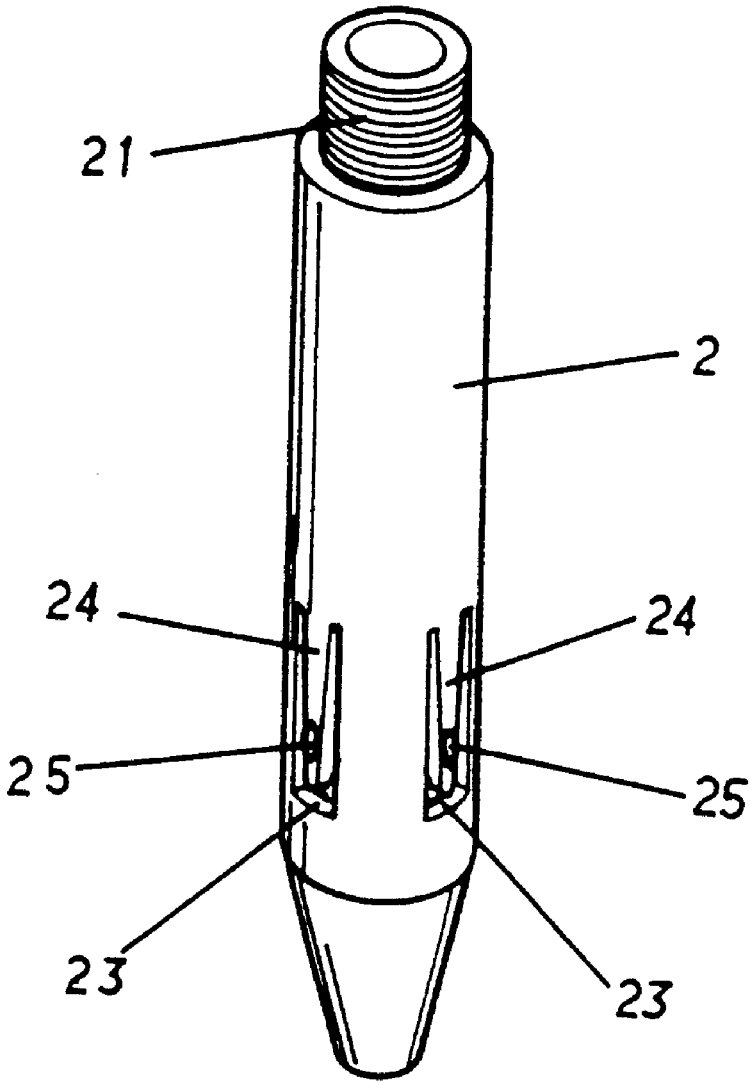
FIG. 9 is a view showing an appearance of a lower holder of another preferred embodiment of the present invention.
Figure 10:
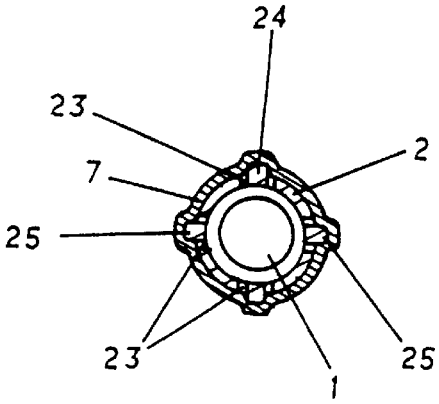
FIG. 10 is a cross sectional view showing the assembly of another preferred embodiment yet of the present invention.
Figure 12:
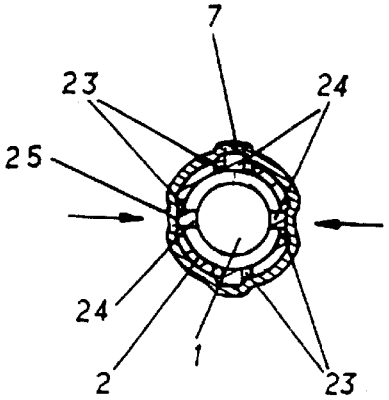
FIG. 12 is a cross sectional view showing that the assembly of another preferred embodiment yet of the present invention is in use.
Figure 11:
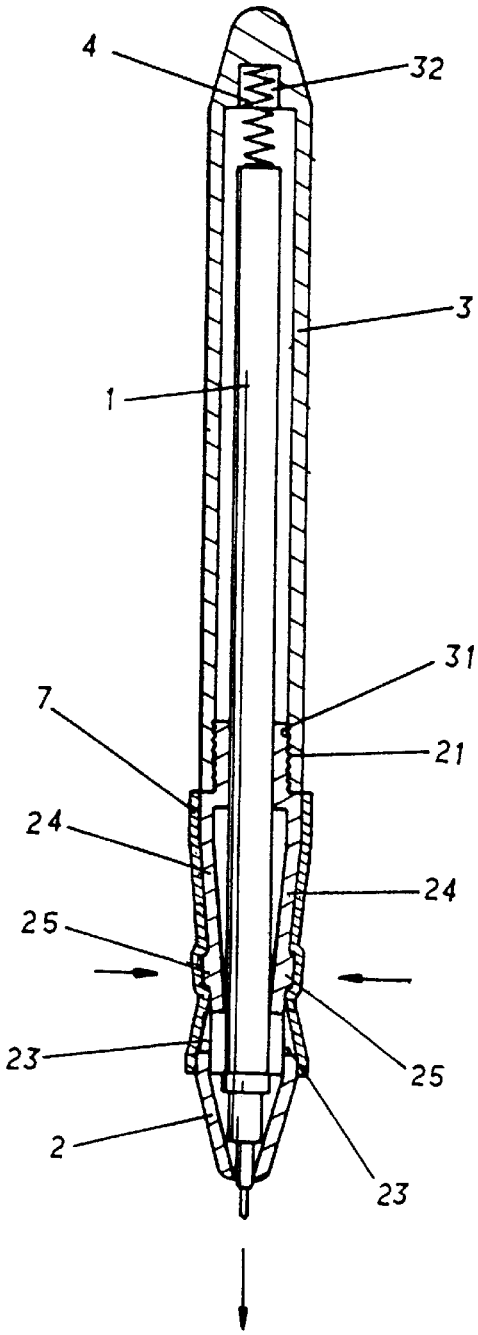
FIG. 11 is a sectional view showing an assembly of another preferred embodiment yet of the present invention is in use.

Now referring to a second preferred embodiment of the present invention as illustrated in FIG. 6, wherein, the coil 4 is inserted into a flange 11 provided on the outer circumference of the top of the refill 1 for the refill 1 to produce the similar buffering to retract and then to restore the refill 1 when by accident the mechanical pen directly falls onto the ground as also illustrated in FIG. 7 to prevent the refill 1 from breaking. Furthermore, as illustrated in FIG. 8, both of the upper holder 2 and the lower holder 3 are integrated into penholder 5. Wherein, a cover 62 having an internally threaded portion 61 is engaged by an externally threaded portion 51 at the top of the penholder 5; and a recess 62 to accommodate the coil 4 is provided inside the cover 6 to facilitate the assembly of the present invention. Multiple holes 52 are provided external to the base of the penholder 5 to allow penetration by those stubs 71. In a third preferred embodiment of the present invention as illustrated in FIGS. 9 and 10, at least two slots 23 are provided at the outer side of the lower holder 2. A resilient tongue 24 extends downwards from the top inside each slot 23 and a protrusion 25 is provided on the outer side of the resilient tongue 24. When the lower holder 2 is inserted into the collet 7 and excessive force is exercised to overcome resilience of the coil 4 to retract the refill 1, such retraction can be prevented by pressing the protrusion 25 for the resilient tongue 24 to deflect inward as illustrated in FIG. 11, and thus to hold against the outer side of the refill 1 as illustrated in FIG. 12.

As disclosed above, the present invention offers the following improvements when compared to its prior art:

(1) To facilitate writing without interruption. Buffing action is produced by the coil 4 prevents the refill 1 from being retracted due to excessive force is applied to the refill 1 by pressing against the base of the collet 7 for the refill 1 to be retained by those stubs 71.

(2) To attract the consumer's buying desire of the pen. As the refill 1 is retained by those stubs 71 of the collet 7 to prevent retraction into the lower holder 2, the writing is not interrupted and the well facilitated delivery of the ink from the refill 1 helps produce a nice and neat writing.

(3) To maintain normal writing. In the normal operation for delivering the ink by the refill 1, the coil 4 overcomes the counterforce rising up against the pen to ensure that the refill 1 is not retracted into the penholder.

(4) To extend service of the pen. Buffering provided the coil 4 also protects the refill 1 from being deformed or even broken up when the mechanical pen accidentally falls on the ground by retracting the refill 1 to avoid direct impact against the ground.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A writing implement comprising:

an upper holder having a recess at a top end thereof;

a lower holder engaged to said upper holder and having an opening at a lower end thereof;

a refill positioned within said upper and lower holders and having a writing end thereof capable of protruding through said opening;

a coil positioned between said recess and a top end of said refill to bias said writing end through said opening;

a plurality of through-holes at equal spacing positioned on a lower end of said lower holder; and a rubber collet into which said lower holder is inserted, said rubber collet having a plurality of stubs thereon which respectively protrude through said through-holes whereby when a user grasps said rubber collet, said stubs are protruded through said through holes and engage said refill in order to secure the position of said refill within said upper and lower holders and when a user releases said rubber collet, said stubs no longer secure the position of said refill such that said refill is capable of axially moving within said upper and lower holders.

* * * * *